US005268091A

United States Patent [19]

Boitiaux et al.

[11] Patent Number: 5,268,091

[45] Date of Patent: Dec. 7, 1993

[54] METHOD FOR REMOVING ARSENIC AND PHOSPHORUS CONTAINED IN LIQUID HYDROCARBON CUTS, NICKEL BASED RETAINING MATERIAL

[75] Inventors: Jean P. Boitiaux, Poissy; Philippe Courty, Houilles; Patrick Sarrazin, Rueil Malmaison, all of France

[73] Assignee: Institut Francais du Petrole, Rueil Malmaison, France

[21] Appl. No.: 700,120

[22] Filed: May 10, 1991

Related U.S. Application Data

[62] Division of Ser. No. 562,296, Aug. 3, 1990, abandoned.

[30] Foreign Application Priority Data

Aug. 8, 1989 [FR] France ..... 89 10756

[51] Int. Cl.[5] ..... C10G 17/02

[52] U.S. Cl. ..... 208/251 R; 208/253; 208/299; 208/310 R; 208/244; 585/820; 585/850; 585/855

[58] Field of Search ..... 208/310 R, 251 R; 423/245.1; 585/820, 826

[56] References Cited

U.S. PATENT DOCUMENTS

| | | | |
|---|---|---|---|
| 3,186,957 | 6/1965 | Stiles | 502/335 |
| 3,368,982 | 2/1968 | Milbourne | 502/335 |
| 3,436,358 | 4/1969 | Thygesen | 502/524 |
| 4,097,412 | 6/1978 | Muller | 502/335 |
| 4,191,664 | 3/1980 | McArthur | 502/335 |
| 4,402,870 | 9/1983 | Schurmans | 502/439 |
| 4,456,703 | 6/1984 | Aldridge | 502/524 |
| 4,861,939 | 8/1989 | Debras et al. | 585/820 |
| 4,880,524 | 11/1989 | Kemp | 208/251 H |
| 4,880,526 | 11/1989 | Kemp | 208/251 H |
| 4,923,592 | 5/1990 | Abdo | 208/251 H |
| 4,933,159 | 6/1990 | Nowack et al. | 585/820 |
| 4,962,272 | 10/1990 | Cullo | 585/820 |
| 4,992,620 | 2/1991 | Nowack et al. | 585/820 |
| 5,064,626 | 11/1991 | Johnson et al. | 585/820 |

*Primary Examiner*—Helane Myers

*Attorney, Agent, or Firm*—Millen, White, Zelano, & Branigan

[57] ABSTRACT

A method for removing arsenic and/or phosphorus from a petroleum charge with a retaining material comprising:

(a) from 60 to 97% of a carrier containing, by weight, from 1.5 to 60% of oxide of at least one metal A selected from the group consisting of Mg, Ca, Sr, Ba, Mn, Fe, Co, Ni, Cu and Zn, dissolved in alumina in the form of aluminate, and from 40 to 98.5% of at least one alumina, (b) from 3 to 40% of nickel oxide, with which the carrier is impregnated by exchange or depositing, and (c) possibly from 0 to 1% of platinum and/or palladium oxide with which the carrier is impregnated.

25 Claims, No Drawings

METHOD FOR REMOVING ARSENIC AND PHOSPHORUS CONTAINED IN LIQUID HYDROCARBON CUTS, NICKEL BASED RETAINING MATERIAL

This application is a division of application Ser. No. 07/562,296, filed Aug. 3, 1990, now abandoned.

BACKGROUND OF THE INVENTION

The invention concerns a retaining material, particularly for removing arsenic and/or phosphorus from a petroleum charge, its method of preparation and its use.

According to their source, crude petroleums may contain traces of many metallic compounds, generally in the form of organo metallic complexes.

These organo metallic compounds are poisons to the catalysts used in petroleum conversion processes.

The organo metallic compounds are chiefly contained in heavy cuts emanating from distillation of crude petroleum. More particularly, heavy cuts from distillation under vacuum contain many metals such as nickel, vanadium or arsenic and non-metallic elements such as phosphorus. However, organic phosphorus compounds will also be described as organo metallic by extension, as the phosphorus is contained in them in the cationic state. These heavy cuts normally undergo thermal or catalytic cracking treatments to convert them to lighter, unsaturated hydrocarbon cuts which can be upgraded better.

Metals such as nickel and vanadium are not generally contained in the effluents. On the other hand arsenic, which is much more able to form volatile compounds, is contained in lighter cuts such as $C_2$ and $C_3$ cuts containing ethylene and propylene; these are generally purified by selective hydrogenation on catalysts based on noble metals, which are respectively poisoned by arsenic reducing compounds such as arsine and methylarsine.

French Patent 2619120 teaches that these reducing compounds can be absorbed, in the gas phase or in the liquid phase, on lead oxide deposited e.g. on alumina.

On the other hand, if heavier cuts such as petrol or naphtha have to be treated, the arsines normally present have a boiling point higher than methylarsine and thus contain one or more hydrocarbon radicals in their molecule. Such compounds have a much weaker reducing power, and reactions for reducing lead oxide are not completed. Absorption materials containing metal oxides such as lead oxide are then ineffective on liquid hydrocarbon cuts of this type. It is the same with organic phosphorus compounds, which cannot be eliminated in this way. Patent FR 2617497 therefore proposes the use of an absorbent material, comprising nickel deposited on a carrier such as silica, magnesia or alumina. However, these retaining materials are found to have a limited effect and limited stability when they are regenerated.

Finally, patents GB-A-1144 497, EP-A-0239 687 and FR-A-2619 121 illustrate the state of the art.

SUMMARY OF THE INVENTION

The subject of the invention is a retaining material, particularly for removing arsenic and/or phosphorus, which is more effective than previously known materials. It is based on nickel, possibly associated with another metal such as palladium or platinum.

The invention also relates to a retaining material which can be regenerated and which is stable; that is to say, its effectiveness is restored by high temperature calcining treatments (generally from 300° to 600° C. and preferably from 450° to 530° C.) in air, a mixture of air and nitrogen or a mixture of air and steam, for 4 to 12 hours.

The invention thus concerns a retaining material, particularly for removing arsenic and/or phosphorus from a petroleum charge, characterized in that it comprises, by weight:

a) from 60 to 97% of a porous carrier containing by weight:
   from 40 to 98.5% of at least one alumina
   from 1.5 to 60% of oxide of at least one metal A dissolved in alumina, in the form of aluminate, selected from the group formed by Mg, Ca, Sr, Ba, Mn, Fe, Co, Ni, Cu and Zn;
b) from 3 to 40% of nickel oxide, with which the carrier is impregnated by exchange or depositing.

One feature of the invention is that the retaining material may further comprise from 0 to 1% and preferably 0.2 to 0.5% by weight of platinum oxide (counted as $PtO_2$) and/or palladium oxide (counted as PdO), with which the carrier is impregnated by exchange or depositing.

Another particularly advantageous feature is that the material for retaining arsenic and/or phosphorus may comprise, by weight:

a) from 65 to 90% of said carrier, containing:
   from 60 to 96% of said alumina,
   from 4 to 40% of said metal oxide A;
b) from 10 to 35% of nickel oxide, with which said carrier is impregnated. The alumina in the carrier is advantageously an alpha or gamma alumina or a mixture of the two.

The alumina has a porosity generally from 20 to 150 and preferably from 50 to 120 $cm^3/g$, and a specific surface area generally from 10 to 300 and preferably from 70 to 200 $m^2/g$.

Another feature of the invention is that for the purpose of utilizing the material it may be subjected to reducing treatment in hydrogen at a temperature of 100° to 500° C., so that at least 10% and preferably at least 50% of said nickel oxide is in metallic form.

A feature of the method of using the retaining material of the invention is that the operating conditions for absorption are moderate, namely a temperature of 110 to 280 and preferably 150° to 220° C. and a pressure of 1 to 100 and preferably 5 to 50 bars. The operation takes place in a hydrogen atmosphere, and the charge is preferably at least partly in liquid phase.

The charge may be a naphtha boiling generally at 40° to 200° C. or a heavy condensate of liquefied gases boiling, e.g., at from 20° to 480° C.

It has been found, surprisingly, that the fact that active nickel is deposited on an aluminous carrier, where the alumina is at least partly combined in aluminate form, makes the nickel substantially more active, and also more stable when the material is regenerated by combustion.

The aluminates used may be aluminates of magnesium, calcium, strontium, barium, manganese, iron, cobalt, nickel, copper or zinc, or mixed aluminates, e.g. those comprising at least two of the metals A in the above-mentioned list.

Single aluminates or mixed aluminates of magnesium, calcium, cobalt, nickel and zinc are preferred, and nickel aluminate is even more preferred.

The above-mentioned aluminates generally have the stoichiometry (A $Al_2O_4$, n $Al_2O_4$) where n ranges from 0 to 10 and where A is at least one of the metals in the above-mentioned list.

The above-mentioned aluminates will generally be prepared by at least one of the methods described below. They may be:

a) Aluminates obtained by impregnating an alumina carrier with an aqueous or non-aqueous solution of at least one salt of at least one metal A in the above list: by drying then thermally activating it at from about 500° to about 800° C., in order to combine at least part of the alumina in the carrier with at least one metal A and to form said aluminate.

The alumina carrier may advantageously be used preformed; for example in the form of spheres, obtained by bowl granulation, by coagulation in drops (oil drop, oil up) or, for example, in the form of extrudates obtained by any extrusion method known in the art.

b) Mass aluminates (aluminates massiques) obtained by hydrolyzing at least one aluminum alkoxide and at least one alkoxide of at least one metal A in the above list. For example the procedure described in U.S. Pat. No. 3,297,414 can thus be used.

c) Mass aluminates obtained more generally by reacting at least one aluminum compound and at least one compound of at least one metal A, to form a sol then a hydrogel by the sol-gel process, described, e.g., in U.S. Pat. Nos. 4,018,834, 4,482,643, 3,408,159, 4,357,427, GB 1,296,049, GB 1,313,750.

d) Mass aluminates obtained by co-precipitation as described e.g. in Applicants' French Patent 2 523 957, from an aqueous solution containing at least one aluminum salt and at least one salt of at least one metal A in the above list, which is reacted with at least one carbonate and/or at least one hydroxide of at least one alkali metal or of ammonium.

e) Mass aluminates obtained by complexing, as described, e.g., in Applicants' French Patents 1 604 707 and 2 045 612.

The aluminates in the form of an intermediate compound, prepared by any of the procedures a) to e) above, can possibly be washed to free them, if necessary, from any troublesome irons which they may contain (alkaline, nitrate, other anions); they are then dried and finally activated by heat.

The aluminates may finally be:

f) industrial aluminates such as aluminous cements of the calcium aluminate or the barium aluminate type, marketed by the French company LAFARGE, or strontium, magnesium or zinc aluminates, or mixed industrial aluminates including at least two of the metals A in the above list, such as mixed calcium and barium aluminates.

g) physical mixtures of at least two of the compounds in a) to f) above, which are subsequently formed.

Aluminates obtained by at least one of procedures a) to g) above will generally be formed, except for those obtained by procedure a), through impregnation of a preformed alumina carrier.

The forming procedures are agglomeration in spheres (bowl granulation), extrusion, pelleting, coagulation in drops (oil drop, oil up) and spray drying to obtain micro grains.

They may be applied either to the moist product, or to the dried product, or to the thermally activated product, or to a mixture of at least two of these products.

Like the forming procedures, the conditions under which the aluminates are prepared are well known in the art, and it is not necessary to repeat them in describing the invention.

The above-mentioned thermal activation is generally carried out from 500° to 800° C. and preferably from 600° to 750° C.

The quantity of metal oxide dissolved in the alumina in the form of aluminate may be controlled by X-ray diffraction.

The proportion of alumina combined in the form of aluminate of at least one metal A will be such that $A/Al_2O_3=0.05$ to 1, and preferably 0.1 to 1 in atoms.

The nickel may be deposited on the aluminate carrier in any suitable manner, such as is known in the art, e.g., from one of its soluble salts, e.g., its nitrate, formate, acetate or acetylacetonate. The nitrate is generally preferred because of its great solubility in water. The nickel may be incorporated, e.g., by "dry" impregnation (filling the porosity of the carrier with a volume of liquid equal to the pore volume of the carrier) from a nickel nitrate solution, so that the weight percentage of metal obtained on the absorbent material is 3 to 50% and preferably 10 to 40%, counted as nicke.. After the impregnation, the catalyst is dried to eliminate at least part of the water, then calcined in air or in another atmosphere containing oxygen, at a temperature of from 300° to 600° C. for 0.5 to 5 hours.

To prepare the retaining material for use, both before its first use and after its regeneration, it is then subjected to reduction in molecular hydrogen or in another atmosphere containing hydrogen, such as a nitrogen-hydrogen, argon-hydrogen or helium-hydrogen mixture, at a temperature of 100° to 500° C.

The mixture of salts of metals such as palladium and/or platinum will be deposited in association with the nickel salt.

The salts should advantageously be chlorides, nitrates or acetylacetonates. The quantity of associated metal (palladium and/or platinum) with which the absorbent material is impregnated is from 0.1 to 5% and preferably from 0.3 to 1% by weight.

After the impregnation the catalyst is dried, then calcined and finally reduced under the same conditions as described above.

Once the absorbent material has been reduced it is put into contact with the charge to be purified, in any appropriate manner. For example, the operation may be carried out in a fixed bed, in an absorption column of cylindrical shape, through which the naphtha to be decontaminated passes in an ascending or descending flow.

The volume of absorbing material can usefully be calculated according to the concentration of arsenic in the hydrocarbon charge, generally from 0.05 to 10 ppm by weight and advantageously from 0.1 to 1 ppm by weight in the case of a naphtha. It can also be calculated according to the concentration of phosphorus in the hydrocarbon charge; this may contain from 0.05 to 10 ppm and advantageously from 0.1 to 1 ppm of phosphorus. Generally speaking, the liquid hourly spatial velocity (LHSV) relative to the volume of material is from 1 to 10 $h^{-1}$, and the hourly throughput of hydrogen is from 0.5 to 10 liters per liter of charge. Excellent results have been obtained with hourly throughputs (LHSV) and hourly hydrogen throughputs respectively from 5 to 10 $h^{-1}$ and from 1 to 5 liters per liter of charge.

The following examples are unrestrictive and are give to illustrate the invention.

EXAMPLE 1 (COMPARISON)

In this example an absorbent material is prepared on a carrier of gamma transition alumina. The specific surface area is 160 $m^2/g$ and the total pore volume 1.1 $m^3/g$.

The macropore volume (pores larger than 0.1 micron) is 0.4 $cm^3/g$.

100 g of spheres of this carrier, with a mean diameter of 2 mm, is impregnated with a nickel nitrate solution with a volume of 110 $cm^3$, containing 20 g of nickel. After impregnation the material obtained is dried at 120° C. for 4 hours, then calcined in air at atmospheric pressure and at 450° C. for 2 hours.

50 $cm^3$ of the absorbent material is placed in a steel tube 3 cm in diameter.

The material is then subjected to reducing treatment under the following conditions:

reducing gas: hydrogen
gas throughput: 20 liters/hour
pressure: 2 bars
temperature: 400° C.
duration: 8 hours.

The retaining material is then cooled, when it has been subjected to the reducing stage up to the testing temperature of 180° C.

A charge comprising a naphtha boiling in the 50° to 130° C. range, containing 500 ppm of sulfur and with 400 ppb of arsenic in the form of triethylarsine added to it, is then passed through in an ascending flow.

Operating conditions are as follows:

temperature: 180° C.
pressure; 25 bars
throughput of charge: variable: 200, 300, 400 $cm^3/h$
throughput of hydrogen: variable: 1, 1.5, 2.0 l/h.

The arsenic content of the product emerging after 300 and 600 hours is determined in each condition.

The results are set out in Table 1.

TABLE 1

| Throughput of naphtha $cm^3/h$ | Arsenic in the product in ppb | |
|---|---|---|
| | After 300 hours | after 600 hours |
| 200 | <50 | <50 |
| 300 | <50 | 325 |
| 400 | 150 | 400 |

It will be seen that the material only remains truly effective if the throughput of naphtha is limited to 200 $cm^3$ per hour, i.e. if LHSV=4 $h^{-1}$.

EXAMPLE 2 (COMPARISON)

After each 600 hour test the absorption column is purged of all the naphtha contained in it. The material is then subjected to "regeneration" in an oxidizing atmosphere of air and steam under the following conditions:

pressure: 1 bar
temperature: 460° C.
steam throughput: 500 g/h
ait throughput: 15 l/h The treatment is carried out for 8 hours.

After the oxidizing treatment the absorbent material is again subjected to reducing treatment as in the previous example. The absorption of arsenic contained in the said naphtha is then resumed under the same conditions.

The results of arsenic analysis after 150 hours are given in Table 2.

TABLE 2

| Throughput of naphtha $cm^3/h$ | Arsenic in the product in ppb |
|---|---|
| 200 | 180 |
| 300 | 300 |
| 400 | 450 |

It will be seen that the oxidizing treatment has not satisfactorily regenerated the absorbent material.

EXAMPLE 3 (ACCORDING TO THE INVENTION)

200 g of the alumina used in Example 1 above is impregnated with 220 $cm^3$ of a solution of magnesium nitrate containing 10 g of magnesium. The material obtained is dried at 120° C. for 4 hours, then calcined in air at atmospheric pressure for 2 hours at 600° C. The solid obtained is marked as solid A. A new solid B is prepared from 100 g of solid A, by impregnating it with a solution containing 20 g of nickel in nitrate form and subjecting it to the same drying and calcining stages as in Example 1.

A solid C is prepared as follows: 200 g of the alumina used above is impregnated with 220 $cm^3$ of nickel nitrate solution containing 10 g of nickel; the material obtained is dried at 120° C. for 4 hours, then calcined in air at atmpspheric pressure for 2 hours at 750° C.

A new solid D is prepared from 100 g of solid C, by impregnating it with a solution containing 20 g of nickel in nitrate form. It is then subjected to the same drying and calcining treatment as in Example 1.

A new solid E is prepared from 100 g of solid C by impregnating it with a solution containing 20 g of nickel and 0.5 g of palladium in the form of nitrates. It is then subjected to the same drying and calcining treatment as in Example 1.

A solid F is prepared as follows: 200 g of the alumina used above is impregnated with 220 $cm^3$ of nickel nitrate solution containing 4 g of nickel; the material obtained is dried at 120° C. for 4 hours then calcined in air at atmospheric pressure, for 2 hours at 750° C.

A new solid G is prepared from 100 g of solid F, by impregnating it with a solution containing 20 g of nickel in nitrate form. It is subjected to the same drying and calcining treatment as in Example 1.

Finally, a new solid H is prepared from 100 g of solid C, by impregnating it with a solution containing 10 g of nickel in nitrate form. It is subjected to the same drying and calcining treatment as in Example 1.

Analysis by X-ray diffraction shows that substantially all the magnesium in solid A and substantially all the nickel is solids C and F are in the form of aluminate. The same test as in Example 1 is carried out with solids A, B, C, D, E, G and H, when they have been reduced in the same way.

The composition of the solids is shown in Table 3.

TABLE 3

| Solid | Carrier Oxide of Alumina Metal A | Oxide of Ni | Oxide of Pd |
|---|---|---|---|
| A | 7.8% + 92.2% = (100%) | | |
| B | 7.8% + 92.2% = (79.6%) | 20.4% | |
| C | 6% + 94% (100%) | | |
| D | 6% + 94% (80%) | 20% | |
| E | 6% + 94% (79.4%) | 20.1% | 0.5% |

TABLE 3-continued

| Solid | Carrier Oxide of Alumina Metal A | Oxide of Ni | Oxide of Pd |
|---|---|---|---|
| F | 2.4% + 97.6% (100%) | | |
| G | 2.4% + 97.6% (80%) | 20% | |
| H | 6% + 94% (91%) | 9% | |

Arsenic analyses carried out after 10 hours, 300 hours and 600 hours are given in Table 4 below.

TABLE 4

| Solid | Throughput of naphtha $cm^3/h$ | Arsenic in the product in ppb After 10 h | After 300 h | After 600 h |
|---|---|---|---|---|
| A | 200 | 400 | 400 | 400 |
| | 300 | 400 | 400 | 400 |
| | 400 | 400 | 400 | 400 |
| B | 200 | <50 | <50 | <50 |
| | 300 | <50 | <50 | <50 |
| | 400 | <50 | <50 | 220 |
| C | 200 | 400 | 400 | 400 |
| | 300 | 400 | 400 | 400 |
| | 400 | 400 | 400 | 400 |
| D | 200 | <50 | <50 | <50 |
| | 300 | <50 | <50 | <50 |
| | 400 | <50 | <50 | 180 |
| E | 200 | <50 | <50 | <50 |
| | 300 | <50 | <50 | <50 |
| | 400 | <50 | <50 | 85 |
| G | 200 | <50 | <50 | <50 |
| | 300 | <50 | <50 | <50 |
| | 400 | 100 | 120 | 250 |
| H | 200 | <50 | <50 | <50 |
| | 300 | <50 | <50 | <50 |
| | 400 | 200 | 250 | 400 |

It will be seen that neither solid A nor solid C is even initially capable of removing the arsenic contained in the naphtha. On the other hand, solids B, D and E are substantially more effective than nickel materials deposited on non-modified alumina.

It will also be seen that solid G, prepared with a hardly aluminated carrier, has a less good performance.

EXAMPLE 4 (ACCORDING TO THE INVENTION)

After each 600 hour test solids B, D, E , G and H are subjected to the same oxidizing "regeneration" treatment with steam as in EXAMPLE 2. The arsenic absorption test is repeated, and the results of analyzing the effluent after 150 hours are given in Table 5 below.

TABLE 5

| Solid | Throughput of naphtha $cm^3/h$ | Arsenic in the product ppm |
|---|---|---|
| B | 200 | <50 |
| | 300 | <50 |
| | 400 | 90 |
| D | 200 | <50 |
| | 300 | <50 |
| | 400 | 80 |
| E | 200 | <50 |
| | 300 | <50 |
| | 400 | <50 |
| G | 200 | <50 |
| | 300 | 200 |
| | 400 | 400 |
| H | 200 | <50 |
| | 300 | 300 |
| | 400 | 400 |

In contrast with Example 2, it will be seen that the regeneration treatment has prolonged the effectiveness of absorption materials B, D and E. On the other hand, material G with little aluminate is less effective.

EXAMPLE 5 (COMPARISON)

A series of tests is carried out on naphtha, boiling within the range of boiling points from 50° to 180° C., containing 500 ppm of sulfur and with 500 ppb by weight of phosphorus in the form triethylphosphine added to it. 50 $cm^3$ of the material from Example 1 is placed in a steel tube 3 cm in diameter and subjected to treatment in hydrogen under the following conditions:

pressure: 2 bars
hydrogen throughput: 20 l/h
temperature: 400° C.
duration: 8 hours.

The charge from which the phosphorus has to be removed is passed through the bed of material in an ascending flow with hydrogen under the following conditions:

throughput of charge: 200 $cm^3/h$ and 400 $cm^3/h$
temperature: 180° C.
pressure: 2–5 bars
throughput of hydrogen: 1 l/h and 2 l/h The content of phosphorus in the product discharge after 100 and 450 hours is determined in each testing condition. The results are given in Table 5 below.

TABLE 5

| Throughput of naphtha $cm^3/h$ | Phosphorus in the product in ppb After 100 hours | After 450 hours |
|---|---|---|
| 200 | <100 | <100 |
| 400 | 225 | 500 |

It is thus advantageous to limit the throughput of naphtha to 200 $cm^3/h$.

EXAMPLE 6 (COMPARISON

After each 450 hour test the material is subjected to "regeneration" treatment identical with that in Example 2. The absorbing material again undergoes reducing treatment as in Example 1, and the absorption of phosphorus contained in the naphtha is repeated, under the same conditions as in the previous example.

The results of phosphorus analysis after 100 hours are given in Table 6 below.

TABLE 6

| Throughput of naphtha $cm^3/h$ | Phosphorus in the product in ppb |
|---|---|
| 200 | 240 |
| 400 | 500 |

EXAMPLE 7 (ACCORDING TO THE INVENTION)

Solids A, B, C, D, E and G from Example 3 are tested in the same way as in Example 6. Analyses of the phosphorus in the product after 10 and 400 hours are given in Table 7.

TABLE 7

| Solid | Throughput of naphtha $cm^3/h$ | Phosphorus in the product ppb | |
|---|---|---|---|
| A | 200 | 500 | 500 |
| | 400 | 500 | 500 |
| B | 200 | <100 | <100 |
| | 400 | <100 | 200 |
| C | 200 | 500 | 500 |

TABLE 7-continued

| Solid | Throughput of naphtha $cm^3/h$ | Phosphorus in the product ppb | |
|---|---|---|---|
| | 400 | 500 | 500 |
| D | 200 | <100 | <100 |
| | 400 | <100 | 150 |
| E | 200 | <100 | <100 |
| | 400 | <100 | <100 |
| G | 200 | <100 | <100 |
| | 400 | <100 | 180 |
| H | 200 | <100 | <100 |
| | 400 | 150 | 300 |

It will be seen that neither solid A nor solid C is even initially capable of removing the phosphorus contained in the naphtha. On the other hand solids B, D, E and to a lesser extent solids G and H are more effective than nickel materials deposited on non-modified alumina.

EXAMPLE 8 (ACCORDING TO THE INVENTION)

After each 400 hour test solids B, D, E, G and H are subjected to he same regenerating treatment as in Example 2. When they have been reduced again the phosphorus absorption test is repeated. The results of analyzing the product after 120 hours are set out in Table 8 below.

TABLE 8

| Solid | Throughput of Naphtha $cm^3$ | Phosphorus in the product in ppb |
|---|---|---|
| B | 200 | <100 |
| | 400 | 150 |
| D | 200 | <100 |
| | 400 | 100 |
| E | 200 | <100 |
| | 400 | <100 |
| G | 200 | <100 |
| | 400 | 120 |
| H | 200 | <100 |
| | 400 | 300 |

The regeneration treatment can be seen to extend the effectiveness of the phosphorus absorbing material.

We claim:

1. A method of removing at least one of arsenic and phosphorus from an at least partially liquid hydrocarbon charge, comprising contacting said charge, molecular hydrogen and a retaining material in a reaction zone, at a temperature of 100° to 250° C. and a pressure of 1 to 100 bars, with an hourly throughput volume (LHSV) relative to the volume of retaining material, of from 1 to 20 $h^{-1}$ and with an hourly throughput of hydrogen of 0.5 to 10 liters per liter of charge, said retaining material comprising by weight:

(a) from 60 to 97% of a carrier containing, by weight, from 1.5 to 60% of oxide of at least one metal A selected from the group consisting of Mg, Ca, Sr, Ba, Mn, Fe, Co, Ni, Cu and Zn, dissolved in alumina in the form of aluminate, and from 40 to 98.5% of at least one alumina, (b) from 3 to 40% of nickel oxide, distributed in pores of said carrier, said retaining material, prior to said contacting, having been subjected to a reducing stage in the presence of molecular hydrogen or a gas containing molecular hydrogen, at a temperature of 100° to 500° C.

2. A method according to claim 1, further comprising regenerating said retaining material by calcining it in an oxidizing atmosphere at 300° to 600° C., and subjecting the retaining material thus regenerated to a reducing stage in the presence of molecular hydrogen or a gas containing molecular hydrogen, at a temperature of 100° to 500° C.

3. A method according to claim 1, wherein the hydrocarbon charge is a naphtha boiling at from 40° to 200° C., or a heavy condensate of liquefied gases boiling at from 20° to 480° C., containing from 0.05 to 10 ppm by weight of arsenic and from 0.05 to 10 ppm by weight of phosphorus.

4. A method according to claim 1, said retaining material further containing in the pores thereof at least one of from 0 to 1% by weight of platinum oxide and from 0 to 1% by weight of palladium oxide.

5. A method according to claim 4, wherein the hydrocarbon charge is a naphtha boiling at from 40° to 200° C., or a heavy condensate of liquefied gases boiling at from 20° to 480° C., containing from 0.05 to 10 ppm by weight of arsenic and from 0.05 to 10 ppm by weight of phosphorus.

6. A process according to claim 1, said retaining material comprising by weight:

(a) from 65 to 90% of said carrier, containing:
from 60 to 96% of said alumina,
from 4 to 40% of said oxide of metal A;

(b) from 10 to 35% of said nickel oxide.

7. A method according to claim 6, wherein the hydrocarbon charge is a naphtha boiling at from 40° to 200° C., or a heavy condensate of liquefied gases boiling at from 20° to 480° C., containing from 0.05 to 10 ppm by weight of arsenic and from 0.05 to 10 ppm by weight of phosphorus.

8. A method according to claim 1, wherein said retaining material has been subjected to said reducing treatment in hydrogen at a temperature of 100° to 500° C., so that at least 10% of said nickel oxide is converted to the metallic form prior to said contacting.

9. A method according to claim 8, wherein the hydrocarbon charge is a naphtha boiling at from 40° to 200° C., or a heavy condensate of liquefied gases boiling at from 20° to 480° C., containing from 0.05 to 10 ppm by weight of arsenic and from 0.05 to 10 ppm by weight of phosphorus.

10. A method according to claim 1, wherein said retaining material has been subjected to said reducing treatment in hydrogen at a temperature of 100° to 500° C., so that at least 50% of said nickel oxide is converted to the metallic form prior to said contacting.

11. A method according to claim 10, wherein the hydrocarbon charge is a naphtha boiling at from 40° to 200° C., or a heavy condensate of liquefied gases boiling at from 20° to 480° C., containing from 0.05 to 10 ppm by weight of arsenic and from 0.05 to 10 ppm by weight of phosphorus.

12. A method according to claim 1, wherein the retaining material is produced by the steps of:

conducting any of the following (a) (1); (a) (2); (a) (3); (a) (4) or (a) (5):

(a) (1) impregnating a preformed or non-preformed alumina carrier with a solution of at least one salt of at least one metal A according to claim 1;

(a) (2) hydrolyzing at least one aluminum alkoxide and at least one alkoxide of at least one metal A;

(a) (3) reacting at least one aluminum compound and at least one compound of at least one metal A, to form a sol then a hydrogel by the sol-gel process;

(a) (4) reacting an aqueous solution of aluminum and at least one compound of at least one metal A with an aqueous solution of at least one precipitating agent, to form at least one co-precipitate, optionally washing the product obtained in steps (a) (1), (a) (2), (a) (3) or (a) (4), then drying it, and thermally activating it at a temperature of 500° to 800° C., to form said aluminate, (a) (5) or employing an already-made aliminate of said at least one metal A, (b) forming the product obtained in step (a) (1), (a) (2), (a) (3), (a) (4) or (a) (5) if it is not already formed, (c) impregnating the product resulting from step (b), by exchange or depositing, with a solution of at least one nickel salt, under conditions such that said nickel salt is distributed into the carrier, (d) at least partly removing water at a temperature of 80° to 200° C., (e) calcining the resultant dried product in the presence of a gas containing molecular oxygen at a temperature of 300° to 600° C., and recovering the retaining material, and (f) subjecting the resultant calcined product to a reducing stage in the presence of molecular hydrogen or a gas containing molecular hydrogen, at a temperature of 100° to 500° C.

13. A process according to claim 12, wherein step (c) further comprises impregnating the product resulting from step (b) with a solution of at least one of a platinum salt and a palladium salt under conditions such that the at least one of a platinum salt and palladium salt is distributed into the carrier.

14. A method according to claim 1, wherein said hourly throughput of hydrogen is 1-5 liters per liter of charge.

15. A method according to claim 1, wherein said aluminate is of the formula A $Al_2O_4$, n $Al_2O_4$, wherein n ranges from 0 to 10.

16. A method of removing at least one of arsenic and phosphorus from an at least partially liquid hydrocarbon charge, comprising contacting said charge, molecular hydrogen and a retaining material in a reaction zone, at a temperature of 100° to 250° C. and a pressure of 1 to 100 bars, with an hourly throughput volume (LHSV) relative to the volume of retaining material, of from 1 to 20 $h^{-1}$ and with an hourly throughput of hydrogen of 0.5 to 10 liters per liter of charge, said retaining material comprising by weight:

(a) from 60 to 97% of a porous carrier containing by weight:

from 40 to 98.5% of at least one alumina, from 1.5 to 60% of oxide of at least one metal A dissolved in alumina, in the form of aluminate, selected from the group consisting of Mg, Ca, Sr, Ba, Ms, Fe, Co, Ni, Cu and Zn; and (b) from 3 to 40% of a mixture of metallic nickel and nickel oxide distributed in pores of the carrier wherein at least 10% of said mixture is said metallic nickel.

17. A method according to claim 16, wherein at least 50% of said mixture is said metallic nickel.

18. A method according to claim 17, wherein the hydrocarbon charge is a naphtha boiling at from 40° to 200° C., or a heavy condensate of liquefied gases boiling at from 20° to 480° C., containing from 0.05 to 10 ppm by weight of arsenic and from 0.05 to 10 ppm by weight of phosphorus.

19. A method according to claim 16, wherein the hydrocarbon charge is a naphtha boiling at from 40° to 200° C., or a heavy condensate of liquefied gases boiling at from 20° to 480° C., containing from 0.05 to 10 ppm by weight of arsenic and from 0.05 to 10 ppm by weight of phosphorus.

20. A method according to claim 16, wherein said hourly throughput of hydrogen is 1-5 liters per liter of charge.

21. A method according to claim 16, wherein said aluminate is of the formula A $Al_2O_4$, wherein n ranges from 0 to 10.

22. A method according to claim 16, wherein said retaining material further comprises platinum or nickel in metallic form.

23. A method of removing at least one of arsenic and phosphorus from an at least partially liquid hydrocarbon charge, comprising:

contacting said charge, molecular hydrogen and a retaining material in a reaction zone, at a temperature of 100° to 250° C. and a pressure of 1 to 100 bars, with an hourly throughput volume (LHSV) relative to the volume of retaining material, of from 1 to 20 $h^{-1}$ and with an hourly throughput of hydrogen of 0.5 to 10 liters per liter of charge, said retaining material comprising a mixture of metallic nickel and nickel oxide, and an aluminate of at least one metal A selected from the group consisting of Mg, Ca, Sr, Ba, Mn, Fe, Co, Ni, Cu, and Zn.

24. A method according to claim 23, wherein said aluminate is of the formula A $Al_2O_4$, n $Al_2O_4$, wherein n ranges from 0 to 10.

25. A method of removing at least one of arsenic and phosphorus from an at least partially liquid hydrocarbon charge, comprising:

contacting said charge, molecular hydrogen and a retaining material in a reaction zone, at a temperature of 100° to 250° C. and a pressure of 1 to 100 bars, with an hourly throughput volume (LHSV) relative to the volume of retaining material, of from 1 to 20 $h^{-1}$ and with an hourly throughput of hydrogen of 0.5 to 10 liters per liter of charge, said retaining material comprising a carrier and a mixture of metallic nickel and nickel oxide, and an aluminate of at least one metal A selected from the group consisting of Mg, Ca, Sr, Ba, Mn, Fe, Co, Ni, Cu, and Zn.

* * * * *